US006663099B2

(12) United States Patent
Inoue

(10) Patent No.: US 6,663,099 B2
(45) Date of Patent: Dec. 16, 2003

(54) APPARATUS FOR TRANSFERRING PAPER SHEETS

(75) Inventor: Nobuo Inoue, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/121,727

(22) Filed: Apr. 15, 2002

(65) Prior Publication Data

US 2002/0163118 A1 Nov. 7, 2002

(30) Foreign Application Priority Data

Apr. 16, 2001 (JP) ..... 2001-117343
Mar. 29, 2002 (JP) ..... 2002-097467

(51) Int. Cl.[7] ..... B65H 1/00
(52) U.S. Cl. ..... 271/162; 271/164; 271/166
(58) Field of Search ..... 271/162, 163, 271/164, 165, 166, 264, 213; 399/405; 221/98

(56) References Cited

U.S. PATENT DOCUMENTS 4,702,466 A 10/1987 DuBois
5,158,221 A * 10/1992 Hashimoto et al. ..... 226/110
5,203,552 A * 4/1993 Hoshi et al. ..... 271/9.01
5,326,093 A 7/1994 Sollitt
5,653,438 A 8/1997 Crowley et al.
5,974,290 A 10/1999 Inoue
5,984,305 A 11/1999 Inoue

FOREIGN PATENT DOCUMENTS

JP 03182431 A * 8/1991
JP 11-79430 3/1999
JP 2001-19221 1/2001

* cited by examiner

*Primary Examiner*—Donald P. Walsh
*Assistant Examiner*—Kaitlin Joerger
(74) *Attorney, Agent, or Firm*—Oblon, Spivak, McClelland, Maier & Neustadt, P.C.

(57) ABSTRACT

An apparatus for transferring paper sheets includes a supply device which supplies sheets, a supply unit which is provided as part of the supply device and forms a supply outlet through which the sheets are ejected, a receiving device which is connected to the supply device in such a manner as to be vertically movable relative to the supply device, and a receiving unit which is provided as part of the receiving device and forms a receiving inlet by which the sheets are received, wherein one of the supply unit and the receiving unit is configured to be vertically movable, and changes a vertical position thereof in response to relative positional relationship between the supply device and the receiving device.

17 Claims, 8 Drawing Sheets

PRIOR ART

APPARATUS FOR TRANSFERRING PAPER SHEETS

BACKGROUND OF THE INVENTION

1. Field of the Invention

The present invention generally relates to paper sheet transfer apparatus, and particularly relates to a paper sheet transfer apparatus comprised of a paper sheet supplying apparatus and a paper sheet receiving apparatus implemented as part of a copier machine or the like.

2. Description of the Related Art

Image forming apparatus such as a printer, a copier, or a facsimile machine is generally provided with options to install peripheral units such as a large-scale paper supply apparatus that stores therein a large number of print sheets, or a post-processing apparatus such as a punch, a mailbox, a paper folding unit, a sorter for sorting printed sheets, etc. Such optional apparatuses are detachable from the image forming apparatus. When an optional apparatus is attached, the positioning thereof relative to the image forming apparatus needs to be carefully made such that sheets are supplied from the paper supply apparatus to the image forming apparatus without paper jam, or are supplied from the image forming apparatus to the post-processing apparatus without paper jam.

FIG. 10 is a drawing showing a paper supply and receipt mechanism of the related art. FIG. 10 shows the configuration of a paper exchanging portion between an image forming apparatus and a large-scale paper supply apparatus. In FIG. 10, upper and lower guide plates 136 and 137 of the paper supply apparatus on the paper supply side are fixed as to their positions, and so are the upper and lower guide plates 36 and 37 of the image forming apparatus on the paper receipt side. In order to insure proper paper feeding even if relative positioning in the vertical direction exhibits displacement for one reason or another, the upper and lower guide plates 36 and 37 of the image forming apparatus are configured to exhibit a large aperture angle. This aperture angle may be too wide in some instances, causing a failure to pass a paper sheet in the case of a curled sheet, thereby causing paper jam.

To obviate this problem, some optional apparatuses are designed to be adjustable as to their positions relative to the image forming apparatus, thereby making it possible to cope with various restrictions imposed regarding the place of installment. Japanese Patent Laid-open Application No. 11-79430 discloses such an optical apparatus. This optional apparatus is a large-scale paper supply apparatus, which includes a paper supply unit and a paper sheet rack that supports the paper supply unit in a position adjustable manner.

In this related-art configuration, the paper supply unit and the paper sheet rack are provided as separate units. Because of this, the paper supply unit needs to be installed by attaching it to the image forming apparatus, and, then, the paper sheet rack has to be installed by attaching it to the paper supply unit. This requires several steps of installation process, and is thus cumbersome. Further, separate housings are necessary for the paper supply unit and the paper sheet rack, respectively, resulting in a cost increase of the large-scale paper supply apparatus.

Accordingly, there is a need for a paper sheet transfer apparatus which can be readily installed and can be taken care of through simple maintenance work while providing proper paper transfer performance.

SUMMARY OF THE INVENTION

It is a general object of the present invention to provide a sheet transfer apparatus that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a sheet transfer apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an apparatus for transferring paper sheets according to the present invention includes a supply device which supplies sheets, a supply unit which is provided as part of the supply device and forms a supply outlet through which the sheets are ejected, a receiving device which is connected to the supply device in such a manner as to be vertically movable relative to the supply device, and a receiving unit which is provided as part of the receiving device and forms a receiving inlet by which the sheets are received, wherein one of the supply unit and the receiving unit is configured to be vertically movable, and changes a vertical position thereof in response to relative positional relationship between the supply device and the receiving device.

In the apparatus described above, the receiving unit on the sheet receiving side and the supply unit on the sheet supply side are configured to be vertically movable, and shift their positions in response to relative positional relationship between the supply device and the receiving device. Even if the supply device is positioned lower than or higher than the receiving device, or is relatively displaced in a vertical direction over a prolonged period of time, proper sheet transfer can be achieved. In order to make the supply unit or the receiving unit vertically movable, they may be configured to swing around a pivot point, or may be configured to be elastically bendable in the vertical direction.

With this provision, it suffices that the supply device and the receiving device be fixed with respect to their horizontal positions, and these two devices can be connected in such a manner that allows for vertical movement. This makes it easier to install the devices and attend to maintenance work while keeping sufficiently proper performance of sheet transfer.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
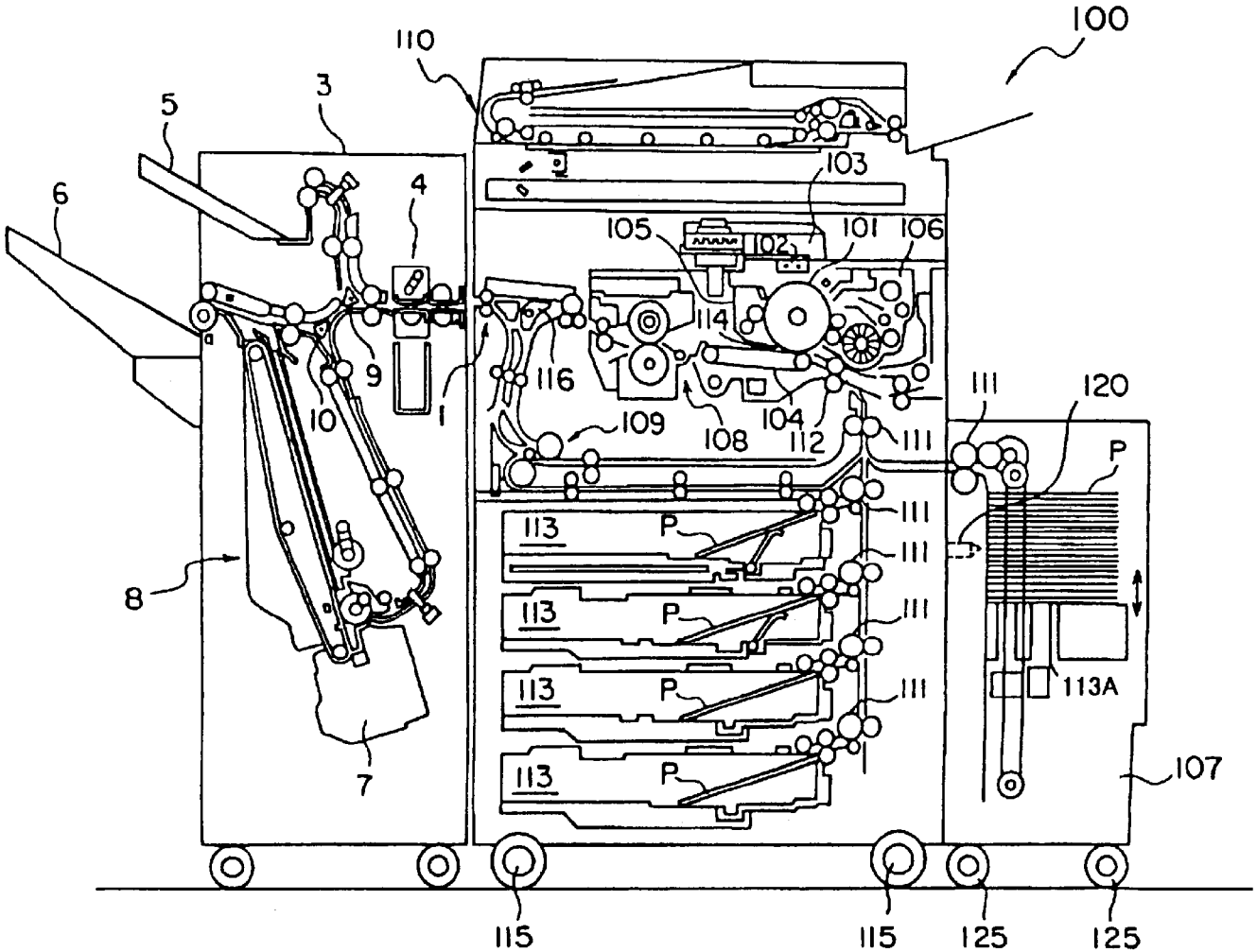
FIG. 1 is a sectional view showing a schematic configuration of an image forming apparatus provided with a large-scale paper supply apparatus and a finisher.
Figure 2:
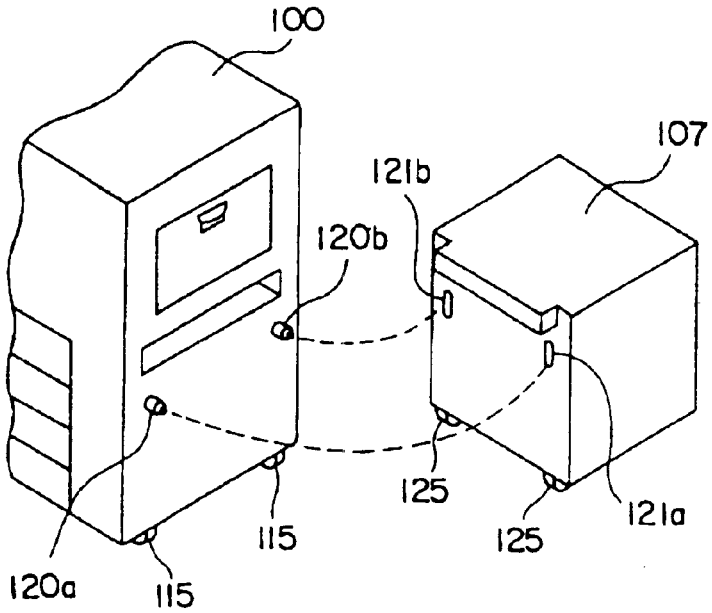
FIG. 2 is an illustrative drawing showing portions where the image forming apparatus and the large-scale paper supply apparatus are connected together.
Figure 3:
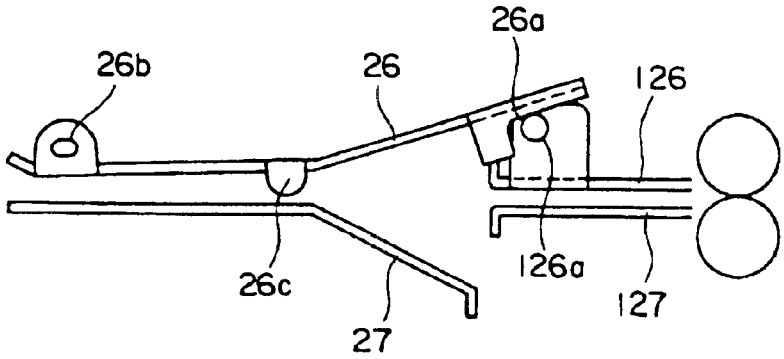
FIG. 3 is a schematic side view for explaining a paper transfer mechanism between the image forming apparatus and the large-scale paper supply apparatus according to a first embodiment of the present invention.
Figure 4:
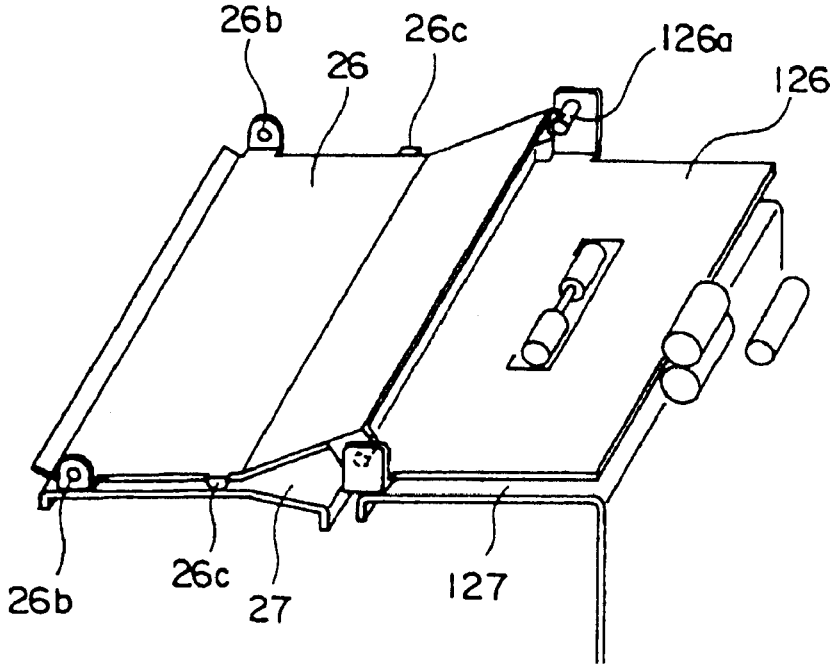
FIG. 4 is an illustrative drawing showing the paper transfer mechanism of FIG. 3.

FIG. 1 is a sectional view showing a schematic configuration of an image forming apparatus provided with a large-scale paper supply apparatus and a finisher. FIG. 2 is an illustrative drawing showing portions where the image forming apparatus and the large-scale paper supply apparatus are connected together. FIG. 3 is a schematic side view for explaining a paper transfer mechanism between the image forming apparatus and the large-scale paper supply apparatus according to a first embodiment of the present invention. FIG. 4 is an illustrative drawing showing the paper transfer mechanism of FIG. 3.

As shown in FIG. 1, an image forming apparatus 100 is provided with optional units that are a large-scale paper supply apparatus 107 and a finisher 3. The present invention is directed to a paper transfer apparatus that transfers paper between an image forming apparatus and an optional unit, and is applicable to a unit for receiving printed sheets from the image forming apparatus as well as a unit for supplying paper sheets to the image forming apparatus. In this example of FIG. 1, a description will be given with regard to the paper transfer mechanism between the large-scale paper supply apparatus 107 and the image forming apparatus 100.

As shown in FIG. 1, the image forming apparatus 100 has a document reader 110 at the top that includes a double-sided document feeding means and a document reading means for performing optical reading of documents. Under the document reader 110, an image forming unit is provided that includes a photosensitive drum 101, an electric charger 102, an exposure unit 103, a conveyor belt 104, a drum cleaning unit 105, and a development unit 106. A paper sheet on which an image is formed by the image forming unit is subjected to fixing process by a fixing unit 108, and is then supplied by a path selecting nail 116 to the finisher 3 through ejection rollers 1 or to a paper sheet returning unit 109 used for printing on both sides of a paper sheet. Under the paper sheet returning unit 109, a paper sheet supply unit comprised of four sheet supply trays 113. Paper sheets P stored in the sheet supply trays 113 are transferred to the image forming unit through transfer rollers 111 and resist rollers 112. The image forming apparatus 100 is provided with casters 115 that support all the weight thereof.

The finisher 3 includes a punch unit 4 for making holes through the paper sheets P supplied through the ejection rollers 1 and a staple unit 7 for stapling the paper sheets P supplied to a staple tray 8. The paper sheets P that are not undergoing stapling are ejected onto an ejection tray 5 situated at the top after being guided thereto by a path selection nail or hook 9. When stapling is necessary, the paper sheets P are supplied to the staple tray 8 by the path selection nails or hooks 9 and 10, and are stapled by the staple unit 7, followed by being ejected onto a paper stack tray 6.

The large-scale paper supply apparatus 107 stores therein a large number of paper sheets P as a stack of paper sheets, and includes a sheet supply tray 113*a*, which has a vertical position thereof adjustable by a powered adjustment mechanism. Paper sheets P supplied from the sheet supply tray 113*a* are ejected from the large-scale paper supply apparatus 107 through ejection rollers 111, and are fed into the image forming apparatus 100 through a paper-sheet inlet. The large-scale paper supply apparatus 107 are provided with casters 125 that support all the weight thereof.

Relative positioning between the image forming apparatus 100 and the large-scale paper supply apparatus 107 is made by engaging pins 120*a* and 120*b* of the image forming apparatus 100 in the vertically elongated holes 121*a* and 121*b* of the large-scale paper supply apparatus 107 as shown in FIG. 2. The pins 120*a* and 102*b* project horizontally from the side panel of the image forming apparatus 100, and the elongated holes 121*a* and 121*b* are formed on the side panel of the large-scale paper supply apparatus 107. With this configuration, horizontal positioning is fixed, while vertical positioning is not fixed in FIG. 1. This makes it easier to attach/detach the large-scale paper supply apparatus 107 to/from the image forming apparatus 100.

In the first embodiment of the present invention, as shown in FIG. 3 and FIG. 4, an upper guide plate 26 of the image forming apparatus 100 is configured to swing around a pivot point 26*b* whereas upper and lower guide plates 126 and 127 of the large-scale paper supply apparatus 107 are provided as fixed members. The upper guide plate 126 is provided with a positioning rod 126*a*, and the upper guide plate 26 of the image forming apparatus 100 has a positioning guide 26*a* that receives the positioning rod 126*a*. Further, the upper guide plate 26 has a stopper 26*c* extending downward and formed as an integral part thereof, which comes in contact with the lower guide plate 27. The stopper 26*c* serves to prevent the upper guide plate 26 from dropping exceedingly when the image forming apparatus 100 stands alone.

Figure 10:
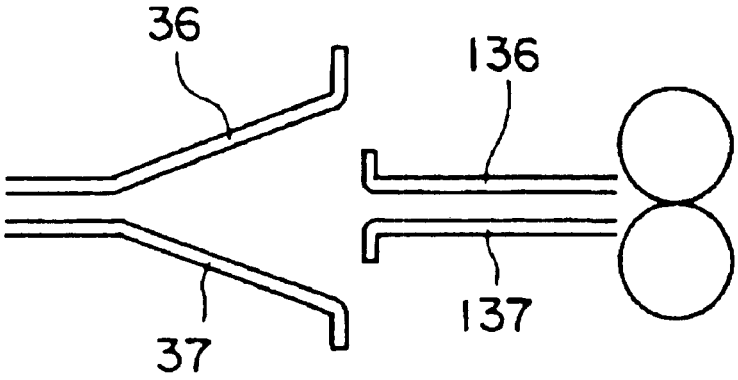
FIG. 10 is a drawing showing a paper supply and receipt mechanism of the related art.

In this embodiment as described above, the upper guide plate 26 of the image forming apparatus 100 on the sheet receiving side is configured to swing freely. This design takes into account weight difference between the image forming apparatus 100 and the large-scale paper supply apparatus 107. If the floor surface is soft in the place where the image forming apparatus 100 is installed, the image forming apparatus 100 heavier than large-scale paper supply apparatus 107 may sink deeper after an extended period of time. In such a case, the upper and lower guide plates 26 and 27 of the image forming apparatus 100 are displaced downward. In the related-art configuration of FIG. 10, the upper guide plate 36 of the image forming apparatus 100 would not provide a sufficient sheet transfer angle. In this embodiment, however, the upper guide plate 26 of the image forming apparatus 100 swings about the pivot point 26*b* as shown in FIG. 3 and FIG. 4, and the positioning rod 126*a* of the upper guide plate 126 fixed to the large-scale paper supply apparatus 107 is pressed against the positioning guide 26*a* of the upper guide plate 26 of the image forming apparatus 100. Through this pressing movement, the upper guide plate 26 swings so as to provide a sufficient sheet transfer angle on the side of the image forming apparatus 100.

Figure 5A:
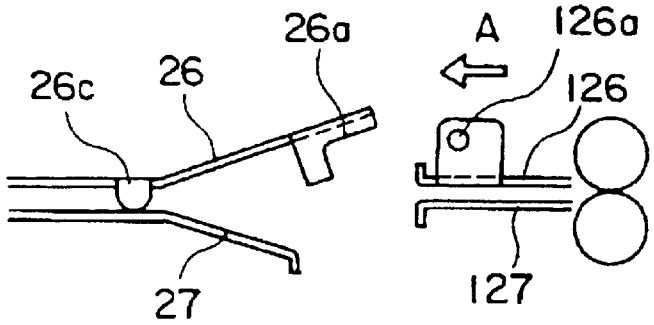
FIGS. 5A and 5B are illustrative drawings for explaining the function of a stopper formed as part of an upper guide plate.
Figure 5B:
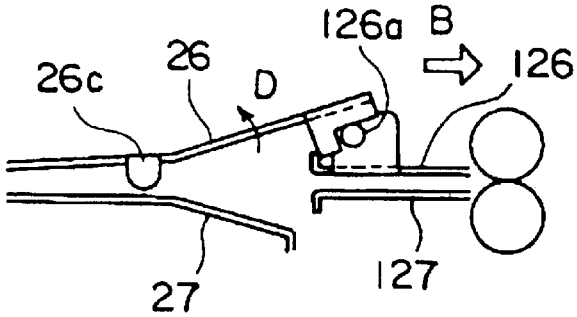

FIGS. 5A and 5B are illustrative drawings for explaining the function of the stopper 26*c* formed as part of the upper guide plate 26. FIG. 5B shows the way the guide plates are positioned when the large-scale paper supply apparatus is attached to the image forming apparatus, and FIG. 5A show the way the guide plates are positioned when the large-scale paper supply apparatus is detached from the image forming apparatus. As shown in FIG. 5A, when the image forming apparatus 100 stands alone before the large-scale paper supply apparatus 107 is attached to the image forming apparatus 100, the upper guide plate 26 of the image forming apparatus 100 is supported by the lower guide plate 27 as the stopper 26*c* is pressed against it. When the large-scale paper supply apparatus 107 comes in contact with an then slides on the positioning guide 26*a* of the upper guide plate 26 of the image forming apparatus 100. As a result, the upper guide plate 26 of the image forming apparatus 100 swings in the direction indicated by an arrow D in FIG. 5B, and comes to a halt. When this happens, the image forming apparatus 100 and the large-scale paper supply apparatus 107 are fixed with each other through connecting means (not shown).

When the image forming apparatus 100 is detached from the large-scale paper supply apparatus 107, the connecting means is disengaged, and the large-scale paper supply apparatus 107 is moved away in the direction shown by an arrow B in FIG. 5B. In conjunction with this movement, the positioning rod 126*a* of the upper guide plate 126 fixed to the large-scale paper supply apparatus 107 is detached from the positioning guide 26*a* of the upper guide plate 26 of the image forming apparatus 100 after sliding thereon. This results in the stopper 26*c* of the upper guide plate 26 coming into contact with the lower guide plate 27 fixed in the image forming apparatus 100.

The embodiment described above has been described by referring to an example in which paper sheets are transferred between the image forming apparatus 100 and the large-scale paper supply apparatus 107. It should be noted that the same configuration as described above may be used for sheet transfer between the image forming apparatus 100 and the finisher 3.

Figure 6:
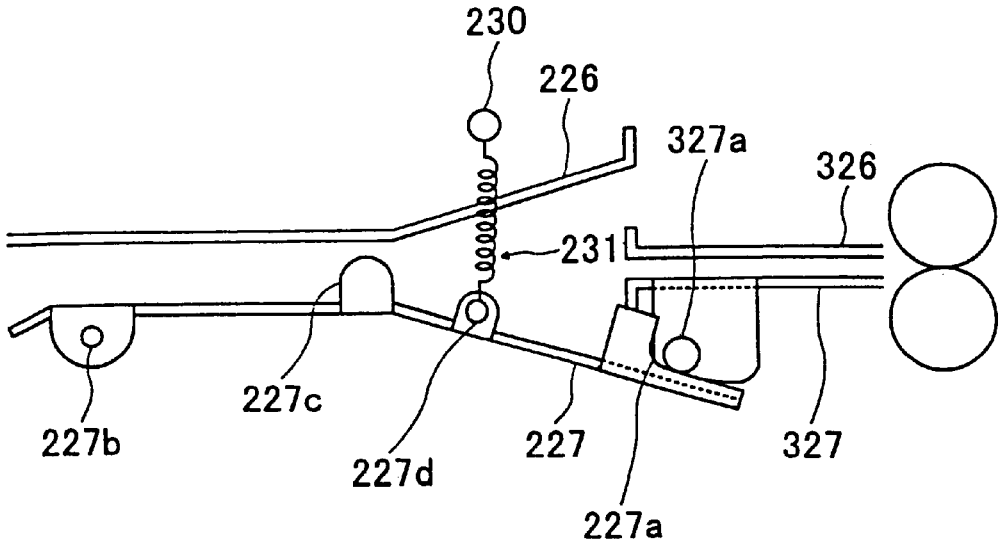
FIG. 6 is an illustrative drawing showing the configuration of guide plates of the image forming apparatus and the large-scale paper supply apparatus according to a second embodiment of the present invention.

FIG. 6 is an illustrative drawing showing the configuration of guide plates of the image forming apparatus and the large-scale paper supply apparatus according to a second embodiment of the present invention.

In the second embodiment of the present invention, as shown in FIG. 6, a lower guide plate 227 of the image forming apparatus 100 is configured to swing around a pivot point 227*b* whereas upper and lower guide plates 326 and 327 of the large-scale paper supply apparatus 107 are provided as fixed members. The lower guide plate 327 is provided with a positioning rod 327*a*, and the lower guide plate 227 of the image forming apparatus 100 has a positioning guide 227*a* that receives the positioning rod 327*a*. The lower guide plate 227 has a hooking part 227*d*, to which a coil spring 231 is hooked at one end thereof. The other end of the coil spring is fixed to a spring fixing part 230 that is situated at a predetermined position inside the image forming apparatus 100. The coil spring 231 serves to pull up the lower guide plate 227 at all times, thereby preventing the lower guide plate 227 from dropping from its own weight. The lower guide plate 227 has a stopper 227*c* extending upward and formed as an integral part thereof, which comes in contact with the upper guide plate 226. The stopper 227*c* serves to prevent the lower guide plate 227 from being lifted exceedingly when the image forming apparatus 100 stands alone.

In this embodiment as described above, the lower guide plate 227 of the image forming apparatus 100 on the sheet receiving side is configured to swing freely. With this provision, even if the large-scale paper supply apparatus 107 sinks lower than the image forming apparatus 100, proper sheet transfer can be achieved from the large-scale paper supply apparatus 107 to the image forming apparatus 100.

Figure 7:
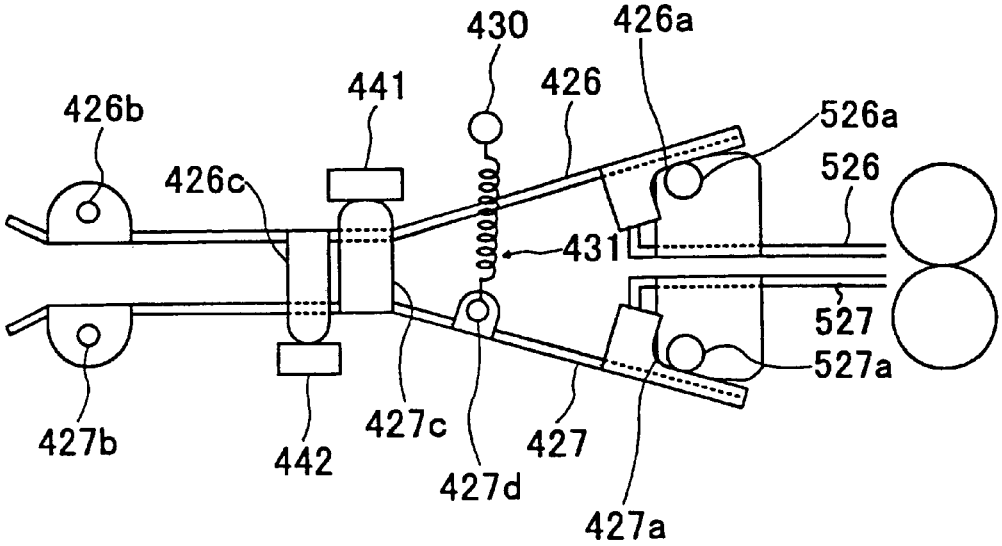
FIG. 7 is an illustrative drawing showing the configuration of guide plates of the image forming apparatus and the large-scale paper supply apparatus according to a third embodiment of the present invention.

FIG. 7 is an illustrative drawing showing the configuration of guide plates of the image forming apparatus and the large-scale paper supply apparatus according to a third embodiment of the present invention.

In the third embodiment of the present invention, as shown in FIG. 7, an upper guide plate 426 of the image forming apparatus 100 is configured to swing around a pivot point 426*b*, and a lower guide plate 427 is also configured to swing around a pivot point 427*b*. In the large-scale paper supply apparatus 107, an upper guide plate 526 is secured in a fixed position and provided with a positioning rod 526*a*, and a lower guide plate 527 is secured in a fixed position and provided with a positioning rod 527*a*. In the image forming apparatus 100, the upper guide plate 426 has a positioning guide 426*a* that receives the positioning rod 526*a*, and the lower guide plate 427 has a positioning guide 427*a* that receives the positioning rod 527*a*. The lower guide plate 427 has a hooking part 427*d*, to which a coil spring 431 is hooked at one end thereof. The other end of the coil spring 431 is fixed to a spring fixing part 430 that is situated at a predetermined position inside the image forming apparatus 100. The coil spring 431 serves to pull up the lower guide plate 427 at all times, thereby preventing the lower guide plate 427 from dropping from its own weight.

The upper guide plate 426 has a stopper 426*c* extending downward and formed as an integral part thereof, which comes in contact with an opposite stopper 442 fixedly provided at a predetermined location inside the image forming apparatus 100. The stopper 426*c* serves to prevent the upper guide plate 426 from dropping exceedingly when the image forming apparatus 100 stands alone. By the same token, the lower guide plate 427 has a stopper 427*c* extending upward and formed as an integral part thereof, which comes in contact with an opposite stopper 441 fixedly provided at a predetermined location inside the image forming apparatus 100. The stopper 427*c* serves to prevent the lower guide plate 427 from being lifted exceedingly when the image forming apparatus 100 stands alone.

In this embodiment as described above, the upper and lower guide plates 426 and 427 of the image forming apparatus 100 on the sheet receiving side are configured to swing freely. With this provision, even if the large-scale paper supply apparatus 107 is displaced lower than or higher than the image forming apparatus 100, proper sheet transfer can be achieved from the large-scale paper supply apparatus 107 to the image forming apparatus 100.

Figure 8:
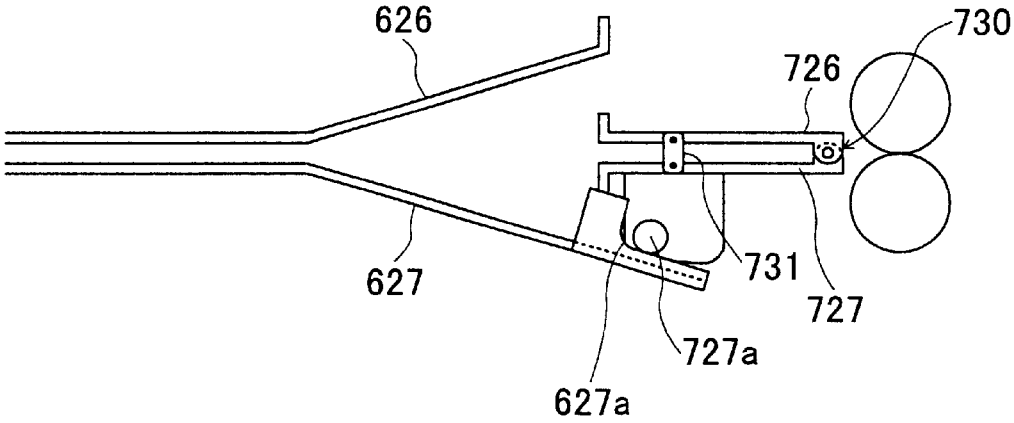
FIG. 8 is an illustrative drawing showing the configuration of guide plates of the image forming apparatus and the large-scale paper supply apparatus according to a fourth embodiment of the present invention.

FIG. 8 is an illustrative drawing showing the configuration of guide plates of the image forming apparatus and the large-scale paper supply apparatus according to a fourth embodiment of the present invention.

In the fourth embodiment of the present invention, as shown in FIG. 8, upper and lower guide plates 626 and 627 of the image forming apparatus 100 are fixed whereas upper and lower guide plates 726 and 727 of the large-scale paper supply apparatus 107 are configured to swing about a pivot point 730. The upper and lower guide plates 726 and 727 are connected together by a connecting member 731 so that a space between the guide plates does not vary with swinging movement. The lower guide plate 727 has a positioning rod 727*a* formed thereon. In the image forming apparatus 100, the fixed lower guide plate 627 has a positioning guide 627*a* formed thereon for the purpose of receiving the positioning rod 727*a*.

In this embodiment, the upper and lower guide plates 726 and 727 of the large-scale paper supply apparatus 107 on the paper supply side are connected together through the connecting member 731 and configured to swing around the pivot point 730, so that the upper and lower guide plates 726 and 727 swing together as one coherent unit without causing a change in the gap space between the guide plates, thereby shifting the position of sheet ejection in a vertical direction. With this provision, even if the large-scale paper supply apparatus 107 is displaced lower than or higher than the image forming apparatus 100, proper sheet transfer can be achieved from the large-scale paper supply apparatus 107 to the image forming apparatus 100.

Figure 9A:
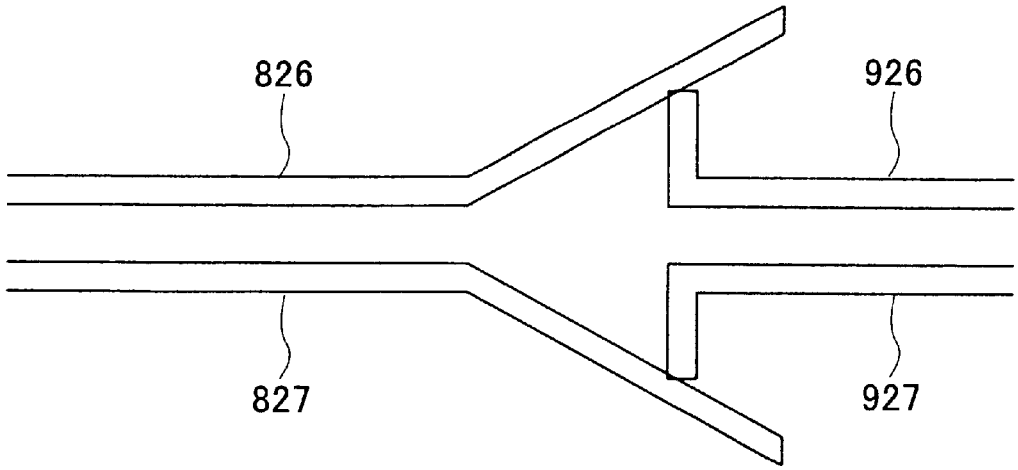
FIGS. 9A and 9B are illustrative drawings showing the configuration of guide plates of the image forming apparatus and the large-scale paper supply apparatus according to a fifth embodiment of the present invention.
Figure 9B:
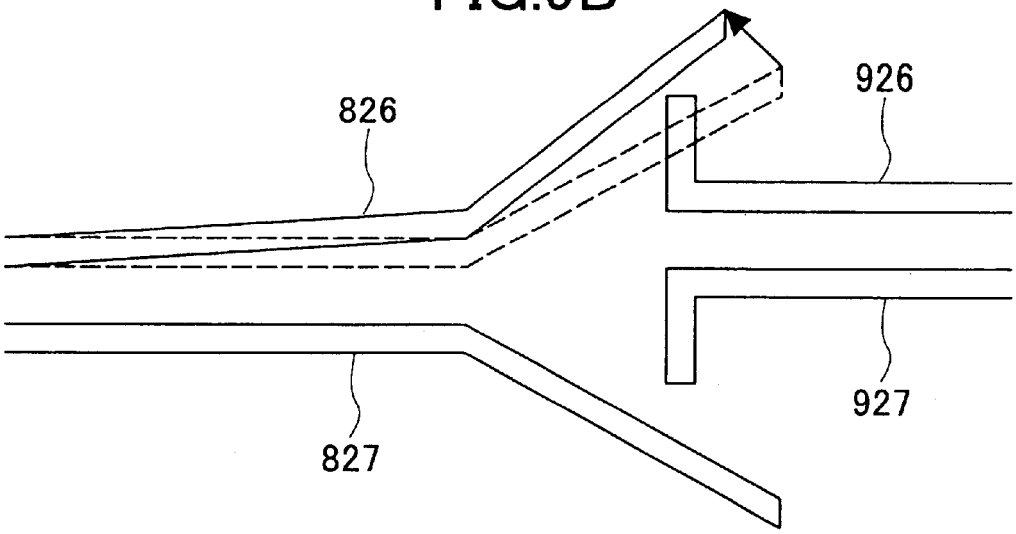

FIGS. 9A and 9B are illustrative drawings showing the configuration of guide plates of the image forming apparatus and the large-scale paper supply apparatus according to a fifth embodiment of the present invention.

In the fifth embodiment of the present invention, as shown in FIG. 9A, upper and lower guide plates 826 and 827 of the image forming apparatus 100 are fixedly mounted, and upper and lower guide plates 926 and 927 of the large-scale paper supply apparatus 107 are also fixedly mounted. The upper and lower guide plates 826 and 827 of the image forming apparatus 100 are made of elastic material, and can change their shapes elastically in response to a stress applied thereto. On the other hand, the upper and lower guide plates 926 and 927 of the large-scale paper supply apparatus 107 are not elastic. With this provision, if the large-scale paper supply apparatus 107 is displaced upward relative to the image forming apparatus 100, the upper guide plate 826 of the image forming apparatus 100 is elastically bent as shown in FIG. 9B, thereby providing a sufficient paper transfer angle. By the same token, if the large-scale paper supply apparatus 107 is displaced downward relative to the image forming apparatus 100, the lower guide plate 827 of the image forming apparatus 100 is elastically bent, thereby providing a sufficient paper transfer angle.

The above description was provided with respect to a case in which the guide plates of the image forming apparatus 100 are elastically bendable. Alternatively, the upper and lower guide plates of the large-scale paper supply apparatus 107 may be configured in such a manner as to be elastically bendable without changing the gap space between the guide plates.

Further, the present invention is not limited to these embodiments, but various variations and modifications may be made without departing from the scope of the present invention.

The present application is based on Japanese priority applications No. 2001-117343 filed on Apr. 16, 2001 and No. 2002-097467 filed on Mar. 29, 2002, with the Japanese Patent Office, the entire contents of which are hereby incorporated by reference.

What is claimed is:

1. An apparatus for transferring paper sheets, comprising:

a supply device which supplies the paper sheets;

a supply unit which is provided as part of the supply device and forms a supply outlet through which the paper sheets are ejected;

a receiving device which is connected to the supply device in such a manner as to be vertically movable relative to the supply device; and a receiving unit which is provided as part of the receiving device and forms a receiving inlet by which the paper sheets are received, wherein one of the supply unit and the receiving unit is configured to be vertically movable, and changes a vertical position thereof in response to relative positional relationship between the supply device and the receiving device.

2. The apparatus as claimed in claim 1, wherein the one of the supply unit and the receiving unit is configured to swing vertically.

3. The apparatus as claimed in claim 1, wherein the one of the supply unit and the receiving unit is configured to be elastically bendable in a vertical direction.

4. The apparatus as claimed in claim 1, wherein the supply unit includes upper and lower supply guide plates situated on an upper side and a lower side, respectively, of the supply unit to face each other, and the receiving unit includes upper and lower receiving guide plates situated on an upper side and a lower side, respectively, of the receiving unit to face each other, the upper and lower supply guide plates being substantially placed between the upper and lower receiving guide plates.

5. The apparatus as claimed in claim 4, wherein at least one of the upper and lower receiving guide plates is configured to swing around a pivot point.

6. The apparatus as claimed in claim 4, wherein the upper and lower supply guide plates swing together as a coherent unit around a pivot point.

7. The apparatus as claimed in claim 4, wherein at least one of the upper and lower supply guide plates is elastically bendable.

8. The apparatus as claimed in claim 4, further comprising a positioning rod and a positioning guide, wherein the positioning rod is connected to one of the upper and lower supply guide plates of the supply unit and connectingly mates with the positioning guide connected to one of the upper and lower receiving guide plates of the receiving unit in order to change the vertical position of the one of the supply unit and the receiving unit in response to the relative positional relationship between the supply device and the receiving device.

9. The apparatus as claimed in claim 1, wherein one of the supply device and the receiving device includes an image forming unit.

10. The apparatus as claimed in claim 1, further comprising a positioning and a positioning guide, wherein the positioning rod is connected to the supply unit and connectingly mates with the positioning guide connected to the receiving unit in order to change the vertical position of the one of the supply unit and the receiving unit in response to the relative positional relationship between the supply device and the receiving device.

11. An apparatus for receiving paper sheets, to be connected to a supply device that supplies the paper sheets, comprising:

a connecting unit for connecting the supply device to the apparatus in such a manner that the supply device is vertically movable relative to the apparatus; and a receiving device including a receiving unit which forms a receiving inlet for receiving the paper sheets supplied from the supply device, and is configured to be vertically movable in response to relative positional relationship between the supply device and the receiving device.

12. The apparatus as claimed in claim 11, further comprising a positioning rod and a positioning guide, wherein the positioning rod is connected to the supply unit and connectingly mates with the positioning guide connected to the receiving unit in order to change the vertical position of the one of the supply unit and the receiving unit in response to the relative positional relationship between the supply device and the receiving device.

13. An apparatus for forming images, to be connected to a supply device that supplies paper sheets, comprising:

a image forming unit which forms images on the paper sheets;

a connecting unit for connecting the supply device to the apparatus in such a manner that the supply device is vertically movable relative to the apparatus; and a receiving device including a receiving unit which forms a receiving inlet for receiving the paper sheets supplied from the supply device, and is configured to be vertically movable in response to relative positional relationship between the supply device and the receiving device.

14. The apparatus as claimed in claim 13, further comprising a positioning rod and a positioning guide, wherein the positioning rod is connected to the supply unit and connectingly mates with the positioning guide connected to the receiving unit in order to change the vertical position of the one of the supply unit and the receiving unit in response to the relative positional relationship between the supply device and the receiving device.

15. The apparatus as claimed in claim 13, wherein the receiving unit is configured to swing vertically.

16. The apparatus as claimed in claim 13, wherein the receiving unit includes upper and lower receiving guide plates situated on an upper side and a lower side, respectively, of the receiving unit to face each other, and upper receiving guide plate being configured to swing vertically.

17. The apparatus as claimed in claim 16, further comprising a positioning rod and a positioning guide, wherein the positioning rod is connected to one of the upper and lower supply guide plates of the supply unit and connectingly mates with the positioning guide connected to one of the upper and lower receiving guide plates of the receiving unit in order to change the vertical position of the one of the supply unit and the receiving unit in response to the relative positional relationship between the supply device and the receiving device.

* * * * *